US009596893B2

(12) United States Patent
Fukuyo et al.

(10) Patent No.: US 9,596,893 B2
(45) Date of Patent: Mar. 21, 2017

(54) EXERCISE GARMENT WITH CROTCH PART

(75) Inventors: Chizuru Fukuyo, Kyoto (JP); Nozomu Seike, Kyoto (JP); Hiroshi Kouno, Tokyo (JP)

(73) Assignee: WACOAL CORP., Kyoto (JP)

( * ) Notice: Subject to any disclaimer, the term of this patent is extended or adjusted under 35 U.S.C. 154(b) by 1655 days.

(21) Appl. No.: 12/091,192

(22) PCT Filed: Sep. 12, 2007

(86) PCT No.: PCT/JP2007/067708
§ 371 (c)(1),
(2), (4) Date: Apr. 23, 2008

(87) PCT Pub. No.: WO2009/034621
PCT Pub. Date: Mar. 19, 2009

(65) Prior Publication Data
US 2010/0162466 A1 Jul. 1, 2010

(51) Int. Cl.
*A41D 13/00* (2006.01)
*A41D 1/08* (2006.01)
*A63B 21/055* (2006.01)

(52) U.S. Cl.
CPC ..... *A41D 13/0015* (2013.01); *A41D 1/08* (2013.01); *A63B 21/055* (2013.01); *A63B 21/4025* (2015.10); *A41D 2400/38* (2013.01)

(58) Field of Classification Search
CPC .. A41D 13/0015; A41D 1/08; A63B 21/4025; A63B 21/055
(Continued)

(56) References Cited

U.S. PATENT DOCUMENTS 750,187 A * 1/1904 Gugenheim et al. ..... 2/401
2,250,218 A * 7/1941 Cadous ..... 2/401
(Continued)

FOREIGN PATENT DOCUMENTS

CN 1461190 12/2003
EP 1 563 748 A1 8/2005
(Continued)

OTHER PUBLICATIONS

Office Action from Chinese Patent Application No. 200780053841.7 dated Apr. 19, 2011.
(Continued)

*Primary Examiner* — Alissa L Hoey
(74) *Attorney, Agent, or Firm* — Jeremy Jay

(57) ABSTRACT

To provide an exercise garment with crotch part that is capable of sufficiently improving performance of various types of exercises accompanied by three-dimensional movements such as rotation of the trunk and rotation/outward rotation/inward rotation of both legs. In an exercise garment with crotch part, when it is being worn, tightening forces of first tightening portions act on the muscle groups existing around the greater trochanter, so that the muscle groups are supported to broaden the extent of mobility of the pelvic band. On the other hand, on the inside of the closed-loop first tightening portions, the space between a first line and a second line gradually becomes wider toward the greater trochanter position, whereby a side hole is formed. Due to such formation of the side hole, the greater trochanter of the wearer is prevented from being pressed directly by the first tightening portions. Therefore, in the exercise garment with crotch part, the first tightening portions can support the muscle groups surrounding the greater trochanter and the side hole can secure flexibility of the pelvic band, whereby
(Continued)

performance of various types of exercises can be effectively improved.

6 Claims, 16 Drawing Sheets

(58) Field of Classification Search
USPC ..... 2/69, 227, 228, 409; 450/101, 115, 122, 450/123, 131
See application file for complete search history.

(56) References Cited

U.S. PATENT DOCUMENTS

| | | | | |
|---|---|---|---|---|
| 2,958,327 | A * | 11/1960 | Geissmann | 450/101 |
| 3,298,373 | A * | 1/1967 | Marchisella | 450/99 |
| 3,542,033 | A * | 11/1970 | Tenusiak | 450/104 |
| 3,793,646 | A * | 2/1974 | Tempelhof | 2/227 |
| 4,089,064 | A * | 5/1978 | Chandler, Jr. | 2/78.2 |
| 4,625,336 | A * | 12/1986 | Derderian | 2/79 |
| 4,862,523 | A * | 9/1989 | Lipov | 2/409 |
| 5,201,074 | A * | 4/1993 | Dicker | 2/70 |
| 5,267,928 | A * | 12/1993 | Barile et al. | 482/124 |
| 5,737,773 | A * | 4/1998 | Dicker et al. | 2/69 |
| 5,888,118 | A * | 3/1999 | Kishi | 450/122 |
| 6,186,970 | B1 * | 2/2001 | Fujii et al. | 602/75 |
| 6,279,161 | B1 * | 8/2001 | Johnston | 2/69 |
| 6,430,753 | B2 * | 8/2002 | Duran | 2/239 |
| 6,728,973 | B1 * | 5/2004 | Webley et al. | 2/400 |
| 6,874,337 | B2 * | 4/2005 | Uno et al. | 66/177 |
| 7,074,204 | B2 | 7/2006 | Fujii et al. | |
| 7,087,032 | B1 * | 8/2006 | Ikeda | 602/19 |
| 7,143,453 | B2 * | 12/2006 | Duran | 2/409 |
| 7,229,390 | B2 * | 6/2007 | Fujii et al. | 482/124 |
| 7,516,498 | B2 * | 4/2009 | Torry | 2/69 |
| 7,559,093 | B2 * | 7/2009 | Sudo et al. | 2/69 |
| 7,631,366 | B2 * | 12/2009 | Oyama et al. | 2/228 |
| 7,670,205 | B2 * | 3/2010 | Oyama et al. | 450/97 |
| 7,730,552 | B2 * | 6/2010 | Ota et al. | 2/69 |
| 7,814,576 | B2 * | 10/2010 | Nakazawa | 2/227 |
| 7,908,670 | B2 * | 3/2011 | Semba et al. | 2/69 |
| 2001/0014981 | A1 * | 8/2001 | Fairhurst et al. | 2/69 |
| 2003/0028952 | A1 * | 2/2003 | Fujii et al. | 2/400 |
| 2003/0101506 | A1 * | 6/2003 | Fujii et al. | 2/240 |
| 2004/0111781 | A1 * | 6/2004 | Miyake et al. | 2/69 |
| 2004/0255358 | A1 * | 12/2004 | Ota et al. | 2/69 |
| 2005/0086721 | A1 * | 4/2005 | Lambertz | 2/69 |
| 2005/0193461 | A1 * | 9/2005 | Caillibotte et al. | 2/69 |
| 2006/0026732 | A1 * | 2/2006 | Nordt et al. | 2/69 |
| 2006/0070164 | A1 * | 4/2006 | Nordt et al. | 2/69 |
| 2006/0169004 | A1 * | 8/2006 | Belluye et al. | 66/177 |
| 2007/0067892 | A1 * | 3/2007 | Oyama et al. | 2/227 |
| 2007/0214541 | A1 * | 9/2007 | Kawasaki et al. | 2/69 |
| 2007/0256217 | A1 * | 11/2007 | Takamoto et al. | 2/401 |
| 2008/0083055 | A1 * | 4/2008 | Onda | 2/455 |
| 2008/0141430 | A1 * | 6/2008 | Rance et al. | 2/67 |
| 2008/0196138 | A1 * | 8/2008 | Takeuchi | 2/79 |
| 2009/0025115 | A1 * | 1/2009 | Duffy et al. | 2/69 |
| 2009/0172858 | A1 * | 7/2009 | Oya et al. | 2/69 |
| 2009/0300826 | A1 * | 12/2009 | Harimoto | 2/403 |
| 2010/0043114 | A1 * | 2/2010 | Caillibotte et al. | 2/69 |

FOREIGN PATENT DOCUMENTS

| | | |
|---|---|---|
| EP | 1 810 649 A1 | 7/2007 |
| JP | 2001-192903 | 7/2001 |
| JP | 2002-212814 | 7/2002 |
| JP | 2005-048332 | 2/2005 |
| JP | 2005-226217 | 8/2005 |
| JP | 2006-144210 | 6/2006 |
| JP | 2006-322121 | 11/2006 |
| JP | 2007-016361 | 1/2007 |
| JP | 2007-023465 | 2/2007 |
| WO | WO 2005/039336 A1 | 5/2005 |

OTHER PUBLICATIONS

European Patent Office, Extended European Search Report in European counterpart Application No. 07807117.2, mailed Feb. 3, 2016.

* cited by examiner (a)

(b)

EXERCISE GARMENT WITH CROTCH PART

CROSS-REFERENCE TO PRIOR APPLICATIONS

This is a U.S. national phase application under 35 U.S.C. §371 of International Patent Application No. PCT/JP2007/067708, filed Sep. 12, 2007, which is incorporated by reference herein.

TECHNICAL FIELD

The present invention relates to an exercise garment with crotch part for supporting exercise of a wearer's trunk and lower limbs.

BACKGROUND ART

In order to improve performance of various types of exercises, it is important to secure flexibility and stability of the lower body and particularly of a pelvic band between the pelvis and hip joint. In recent years, exercise garments with crotch part for improving exercise performance by supporting the lower body have become known. There are very deep-rooted needs on exercise garments with crotch part, and, to take golf as an example, there are evidently many users who wish to increase club swing speed and extend carry distance without doing daily strength training or stretching.

As an exercise garment with crotch part, there is a lower limb protecting garment described in, for example, Patent Document 1. This conventional exercise garment with crotch part has a stretchable body and a support part having a tightening force stronger than that of the body, and a first line of the support part passes from the upper part of the gluteus maximus to the gluteus medius and the greater trochanter, while a second line of the support body passes from the front part of the gluteus medius to the lower part of the gluteus maximus. The support of the lower limb around the greater trochanter makes movement of the leg part in its back and forth directions smooth while walking, and suppresses movement of center gravity to a body axis.

Patent Document 1: Japanese Patent Application Laid-Open No. 2006-322121

DISCLOSURE OF THE INVENTION

Problem to be Solved by the Invention

The abovementioned conventional exercise garment with crotch part is configured such that the first line and second line of the support part intersect with each other at the position of the greater trochanter and the tightening force directly acts on the greater trochanter. However, such a configuration has a problem that excess tightening force acts on the greater trochanter and thereby flexibility of the pelvic band is inhibited. Therefore, in a conventional configuration, three-dimensional movements, such as rotation of the trunk and rotation/outward rotation/inward rotation of both legs, are restricted, and consequently the effects of improving performance of various types of exercises including a swing motion might not be exercised sufficiently.

The present invention has been accomplished to resolve the above problems, and an object thereof is to provide an exercise garment with crotch part that is capable of sufficiently improving performance of various types of exercises accompanied by three-dimensional movements, such as rotation of the trunk and rotation/outward rotation/inward rotation of both legs.

Means for Solving the Problem

To solve the above problems, an exercise garment with crotch part according to the present invention, which is an exercise garment with crotch part that covers at least a part of a wearer's lower body, is characterized in having a main body portion formed from a stretchable material, and a tightening portion having a tightening force stronger than that of the main body portion, wherein the tightening portion has, in side parts of the main body portion, a pair of right and left first tightening portions each of which is formed in a closed-loop shape such as to surround periphery of greater trochanter of the wearer respectively.

Also, the exercise garment with crotch part according to the present invention, which is an exercise garment with crotch part that covers at least a part of a wearer's lower body, is characterized in having a main body portion formed from a stretchable material, and a tightening portion having a tightening force stronger than that of the main body portion, wherein the tightening portion has, in side parts of the main body portion, a pair of right and left first tightening portions each of which is configured by a first line passing through above the greater trochanter of the wearer and a second line passing through below the greater trochanter of the wearer, and is disposed such as to surround the periphery of the greater trochanters as the space between the first line and second line increases toward the position of the greater trochanter.

Moreover, the exercise garment with crotch part according to the present invention, which is an exercise garment with crotch part that covers at least a part of a wearer's lower body, is characterized in having a main body portion formed from a stretchable material, and a tightening portion having a tightening force stronger than that of the main body portion, wherein the tightening portion has, in side parts of the main body portion, a pair of right and left first tightening portions, each of which has disposed therein a plurality of tightening portions that surround the periphery of the greater trochanter of the wearer.

In these exercise garments with crotch part, [each of] the first tightening portions having a tightening force stronger than that of the main body portion is formed such as to surround the periphery of the greater trochanter of the wearer. The first tightening portions facilitate movement of muscle groups such as the gluteus medius, gluteus maximus and tensor fasciae latae muscle that exist around the greater trochanter, and act such that the extent of mobility of the pelvic band is broadened. On the other hand, [each] first tightening portion does not directly press against the greater trochanter so that the greater trochanter itself can move freely. Therefore, these exercise garments with crotch part can realize both support for the muscle groups existing around the greater trochanter and securing flexibility of the pelvic band, and can effectively improve performance of various types of exercises accompanied by three-dimensional movements, such as rotation of the trunk and rotation/outward rotation/inward rotation of both legs.

Also, it is preferred that the tightening portion further have, in a front part of the main body portion, band-like second tightening portions that extend along an inguinal portion of the wearer and are connected to the first tightening portions. The second tightening portions have an action to tilt the wearer's pelvic band slightly forward. The pelvic body keeps the forward-bent position in this manner, whereby mobility of the trunk/lower limb can be further improved.

Moreover, it is preferred that the tightening portion further have, in a back part of the main body portion, third tightening portion that connects the first tightening portions to each other at a position corresponding to the lumbar part of the wearer. The third tightening portion stabilizes the position of the wearer's lumbar part to enhance the comfort during exercise.

Furthermore, it is preferred that [each of] the first tightening portions extends from an upper side of the back part of the main body portion toward a lower side of the front part of the same around the greater trochanter. The position of the greater trochanter during exercise moves mostly obliquely from an upper side of the back toward a lower side of the front when viewed from a side of a human body. Therefore, the direction in which [each of] the first tightening portions extend is associated with the direction of movement of the greater trochanter to thereby mobility of the trunk/lower limb can be further secured.

Moreover, the second tightening portions and the third tightening portion may be formed by a plurality of tightening portions. Even in such a configuration, the action effects described above can be realized.

Effects of the Invention

According to the exercise garment with crotch part of the present invention, performance of various types of exercises accompanied by three-dimensional movements such as rotation of the trunk and rotation/outward rotation/inward rotation of both legs can be sufficiently improved.

EXPLANATION OF REFERENCE NUMERALS

1, 30, 40, 50, 60: exercise garment with crotch part, 10: main body portion, 20: tightening portion, 21, 31, 61: first tightening portion, 21*a*, 61*a*: first line, 21*b*, 61*b*: second line, 22, 42, 62: second tightening portion, 23, 43, 63: third tightening portion, A: greater trochanter position.

BEST MODE FOR CARRYING OUT THE INVENTION

Hereinafter, preferred embodiments of the exercise garment with crotch part according to the present invention are described in detail with reference to the drawings.

Figure 1:
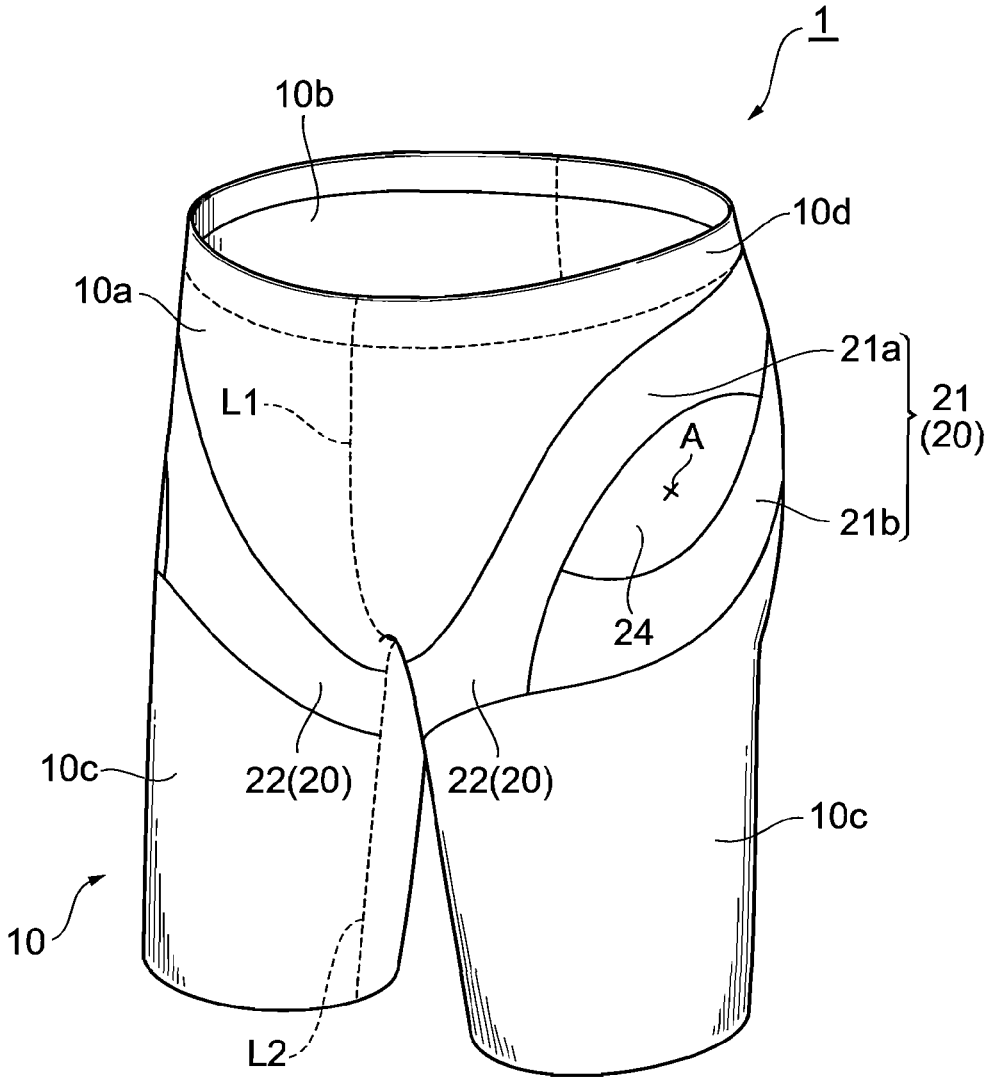
[FIG. 1] A perspective view showing an exercise garment with crotch part according to an embodiment of the present invention.
Figure 2:
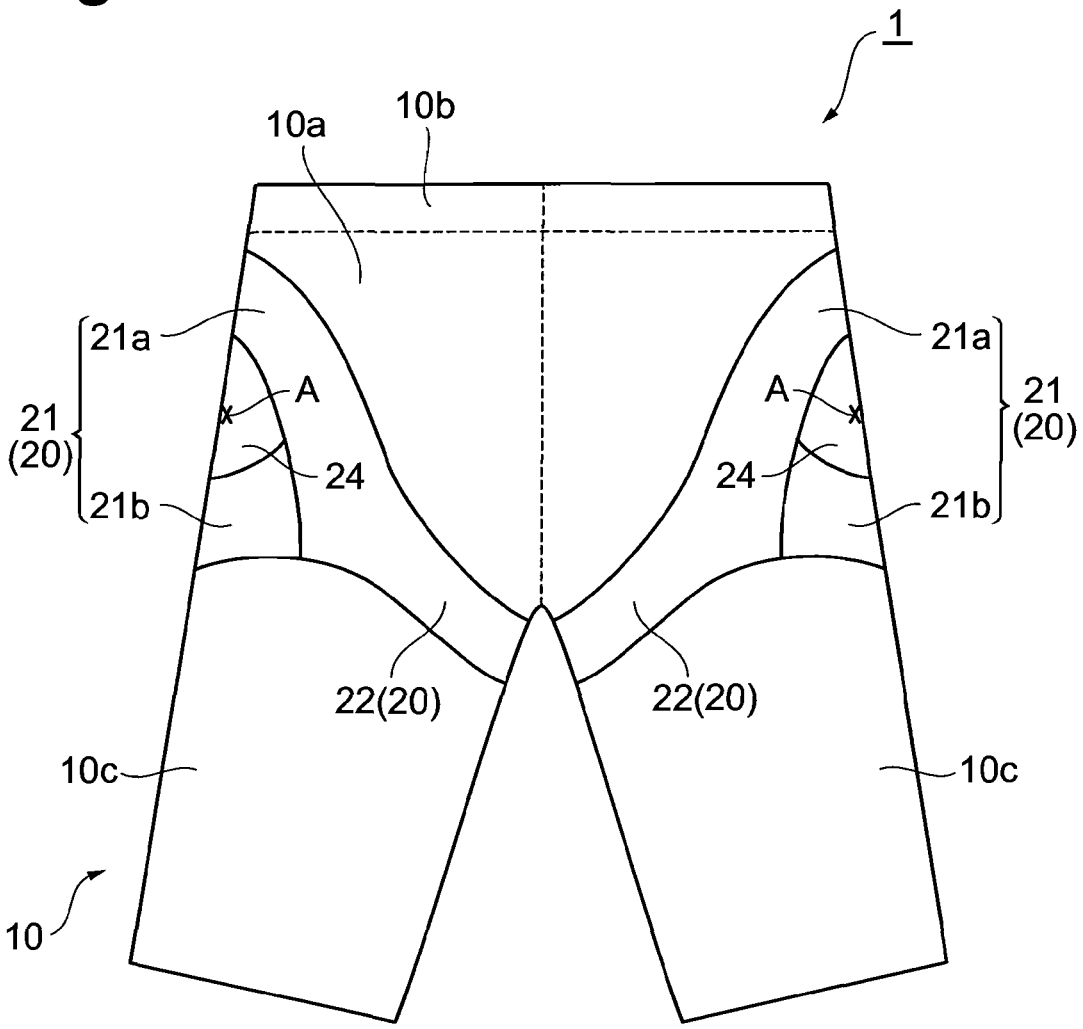
FIG. 2 A front view of the exercise garment with crotch part shown in FIG. 1.
Figure 3:
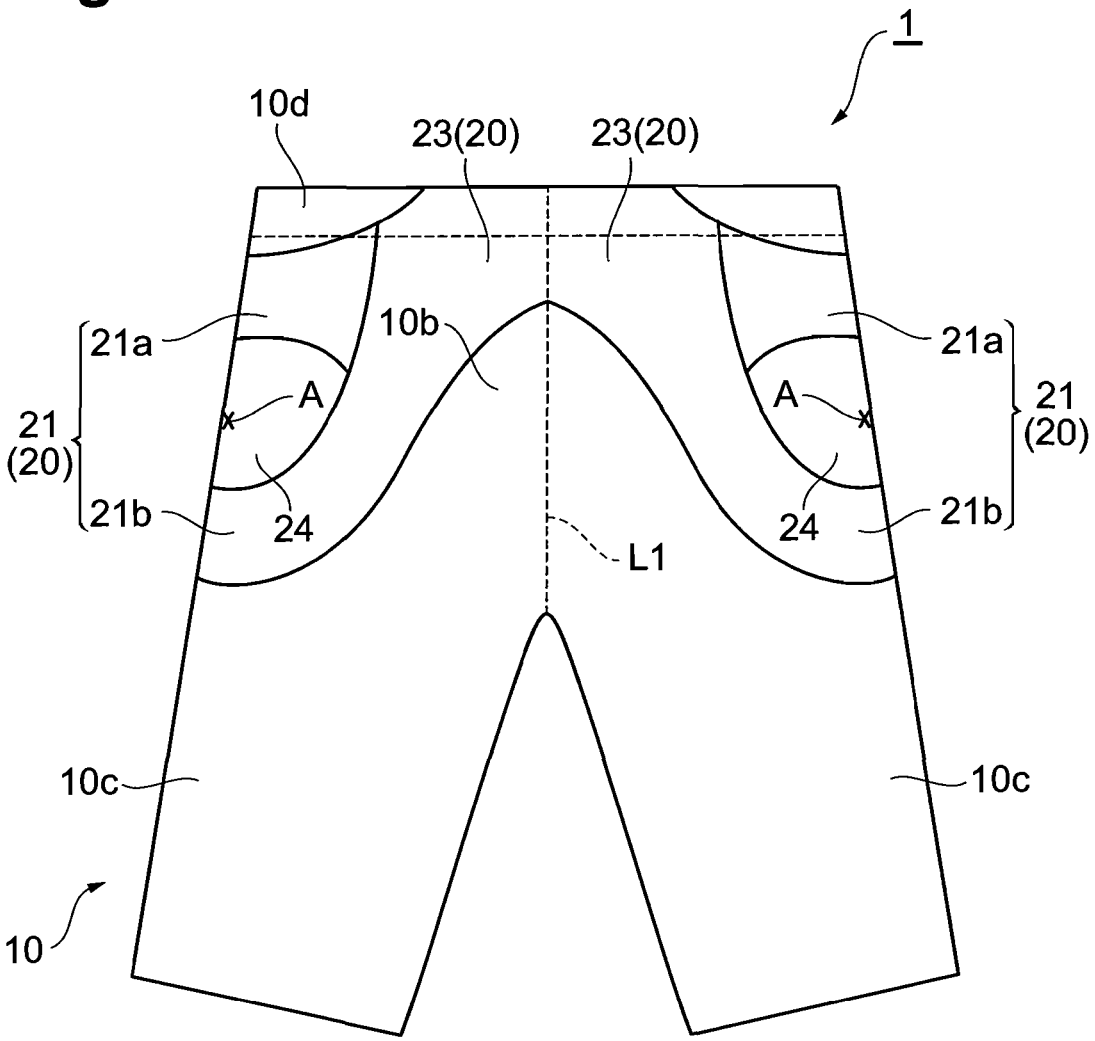
FIG. 3 A back view of the exercise garment with crotch part shown in FIG. 1.
Figure 4:
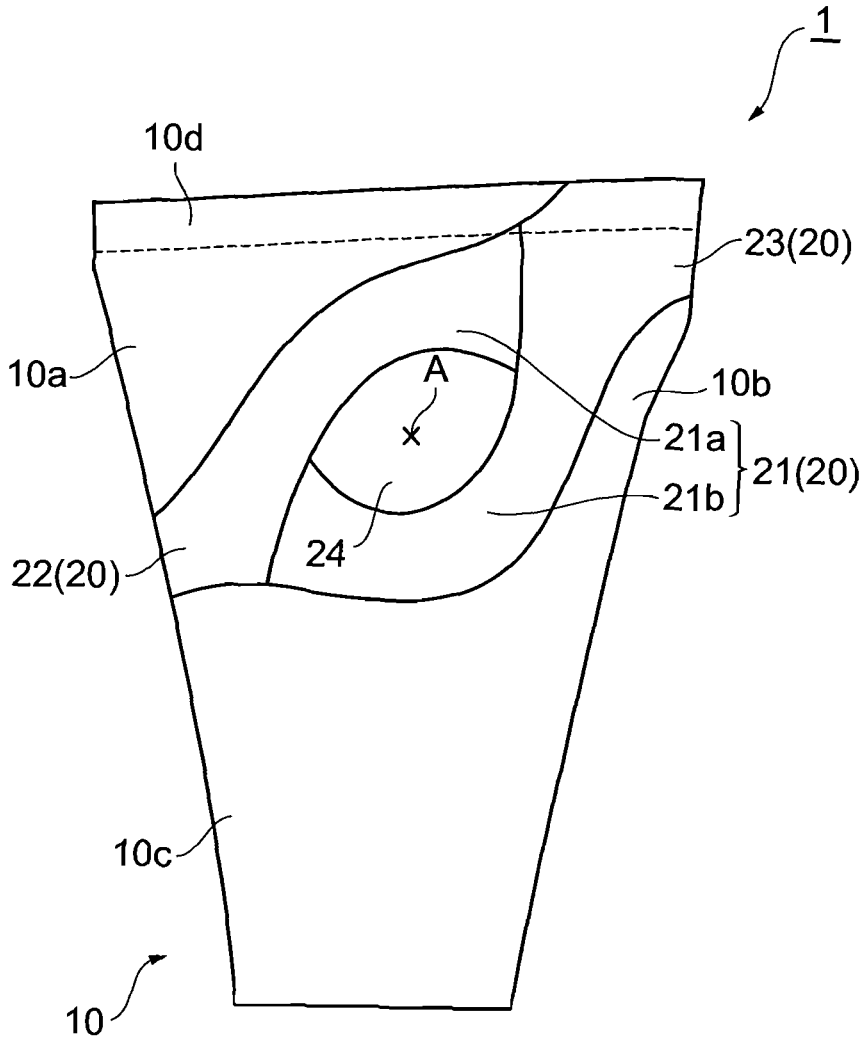
FIG. 4 A side view of the exercise garment with crotch part shown in FIG. 1.
Figure 5:
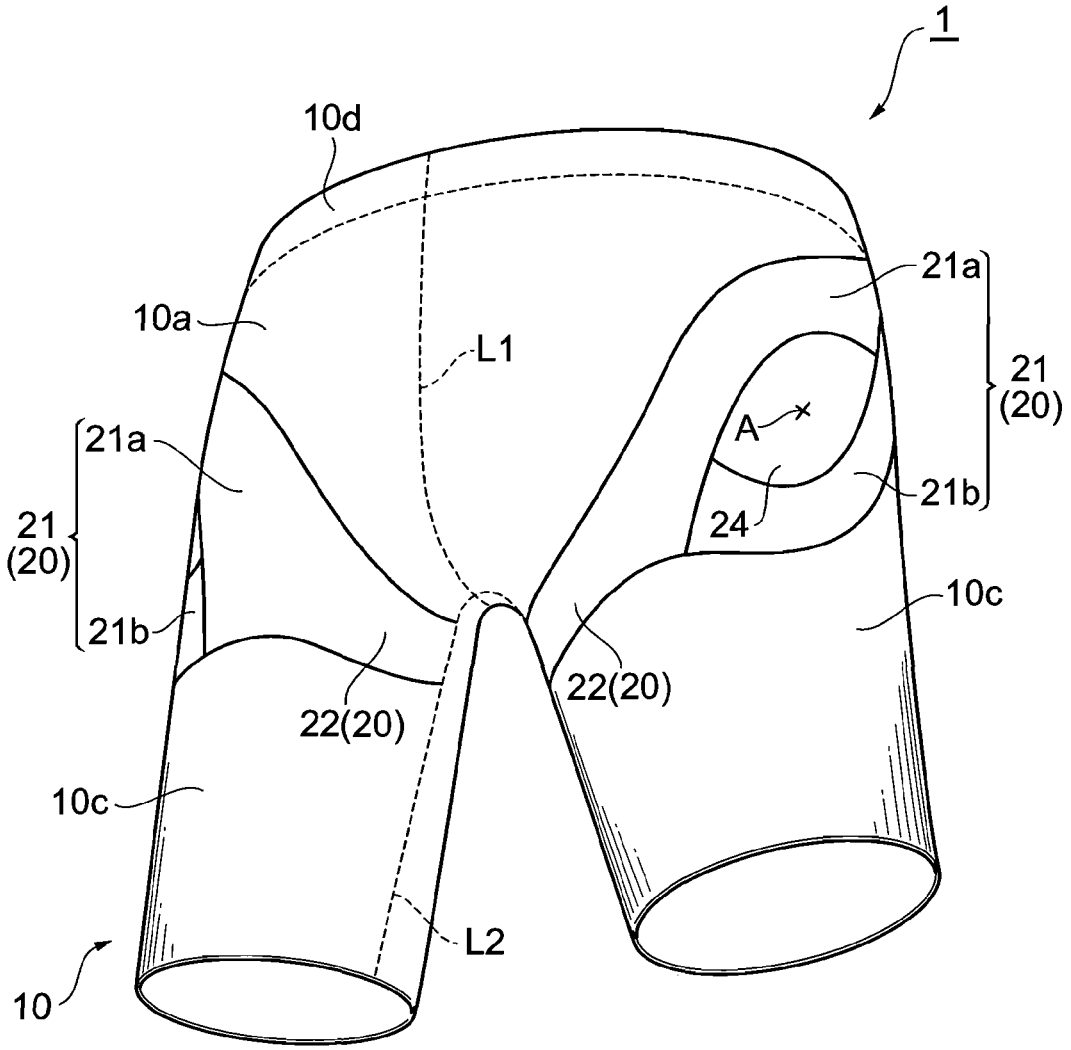
FIG. 5 A perspective view in which the exercise garment with crotch shown in FIG. 1 is viewed from below.

FIG. 1 is a perspective view showing an exercise garment with crotch part according to an embodiment of the present invention. FIGS. 2 through 4 are a front view, a back view and a side view of the exercise garment with crotch part shown in FIG. 1, respectively. Also, FIG. 5 is a view in which the exercise garment with crotch shown in FIG. 1 is viewed from below. FIG. 1 and FIG. 5 show the shapes obtained when [the exercise garment with crotch part] is being worn.

As shown in FIG. 1 through FIG. 5, the exercise garment with crotch part 1 is a spat-like sports garment that is worn with an object of increasing swing speed when, for example, a golfer practices or plays on a course.

The exercise garment with crotch part 1 has a main body portion 10 that is in close contact with [a section between] the lumbar part and a thigh of a wearer, and band-like tightening portions 20 that are sewn onto an outer surface of the main body portion 10. The right and left parts of the main body portion 10 are sewn together along a sewing line L1 that passes along the central part from a front portion 10*a* to a back portion 10*b*. Right and left trouser portions 10*c* of the main body portion 10 are formed by a sewing line L2 that intersects with the sewing line L1 at the center of a crotch part. An inside tape containing rubber, for example, is passed through a waist portion 10*d* of the main body portion 10 so that fit feeling can be secured on the waist when [the exercise garment] is being worn.

As the material constituting the main body portion 10, a stretchable material is used. As such a material, for example, a two-way tricot [fabric] of polyester mixed fiber percentage 82.9% and polyurethane mixed fiber percentage 17.1% can be used. In this case, there is good close contact of the exercise garment with crotch part 1 to the wearer.

The tightening portions 20 are configured from first tightening portions 21 formed on side parts of the main body portion 10 respectively, second tightening portions 22 formed in the vicinity of the crotch part of the main body portion 10, and third tightening portion 23 formed on the back part of the main body portion 10. The tightening portions 20 each have a tightening force stronger than that of the main body portion 10, and a function of using an action of the tightening force to support the wearer's muscles/skeleton of the portions to which the first tightening portions 21 through the third tightening portion 23 are assigned. The tightening portions 20 are formed, for example, by sewing a satin power net of nylon mixed fiber percentage 79% and polyurethane mixed fiber percentage 21% onto the main body portion 10.

Note that instead of being sewn onto the main body portion 10, the tightening portions 20 may be formed by being attached to the main body portion 10, or may be formed by being joined to the main body portion 10. Alternatively, [the tightening portions 20] may be formed integrally with the main body portion 10 by changing the knit of the main body portion 10 or applying on resin such as urethane. Pressure on the tightening portions 20 when [the exercise garment] is being worn is preferably, for example, 0.5 kPa through 2.5 kPa.

Figure 6:
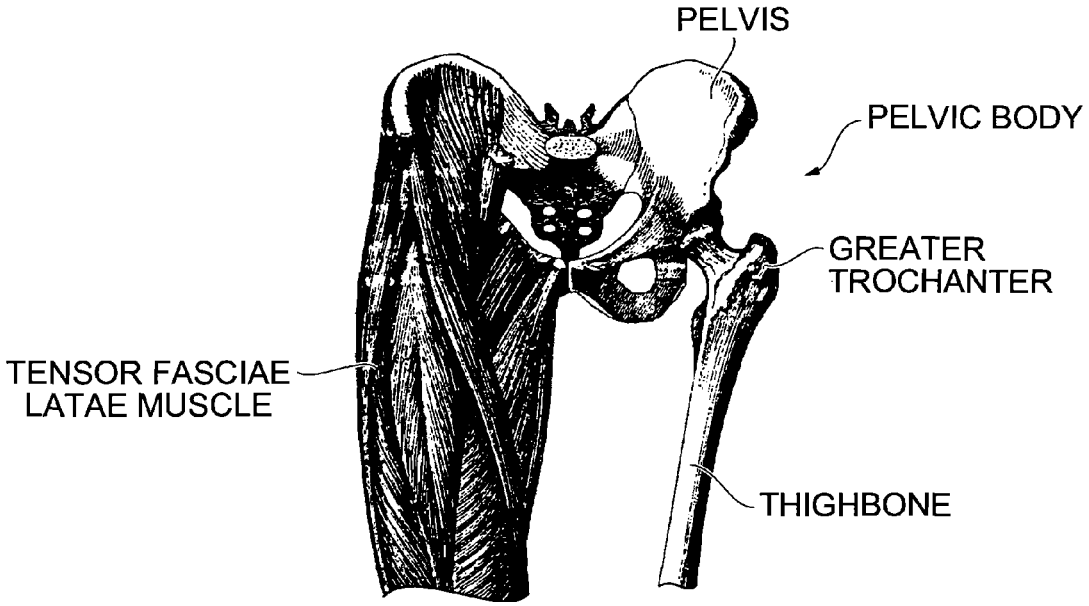
FIG. 6 A view showing bone groups and muscle groups of lower limb portions of a human body viewed from the front.
Figure 7:
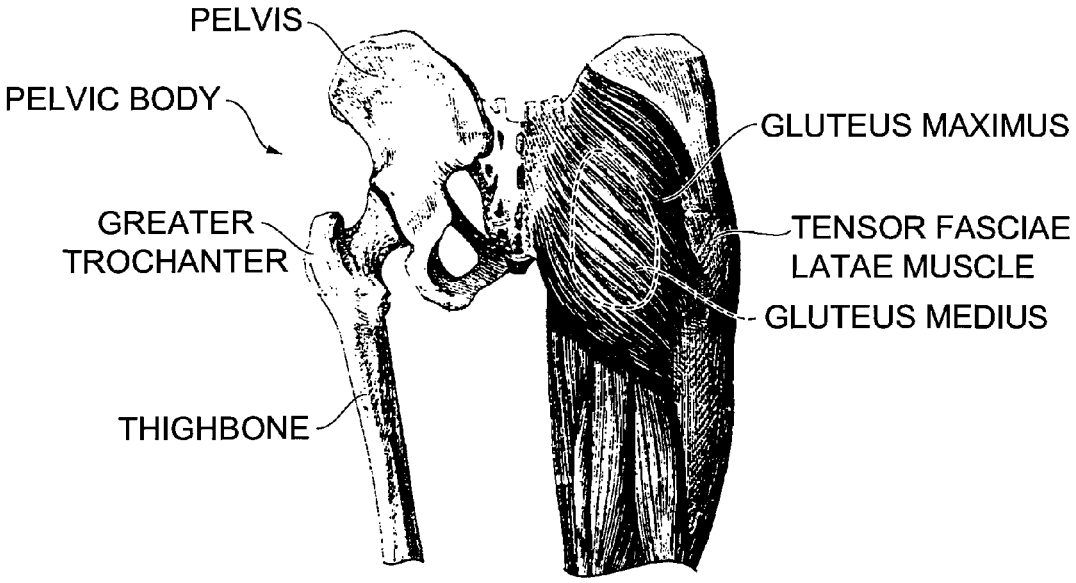
FIG. 7 A view showing bone groups and muscle groups of the lower limb portions of the human body viewed from the back.

Here, before describing the first tightening portions 21 through the third tightening portion 23, the main bones/muscles on which the tightening forces therefrom act are described. FIG. 6 is a view showing bone groups and muscle groups of lower limb portions of a human body viewed from the front. FIG. 7 is a view showing bone groups and muscle groups of the lower limb portions of the human body viewed from the back.

As shown in FIG. 6 and FIG. 7, the pelvic band of a lower limb part of a human body is configured from a pelvis consisting of coxal bone, sacral bone and tail bone, hip joint, and the like. The greater trochanter is located above the femur and protrudes approximately outward from the hip joint. Although many muscles associate with mobility of the pelvic band, the present invention focuses attention to three muscles: gluteus maximus, gluteus mediums, and tensor fasciae latae muscle. The gluteus maximus is located such as to connect the lower part of the pelvis and the upper part of the thighbone together on a surface layer side of buttock, and the gluteus medius is located in the deep portion of the gluteus maximus. The tensor fasciae latae muscle extends vertically along the thighbone from the front part to the side of the thigh.

The first tightening portions 21 are portions that support the muscle groups surrounding the greater trochanter of the wearer. The first tightening portions 21 are formed into a pair on the right and left side portions of the main body portion 10 as shown in FIG. 1 and FIG. 4.

The first tightening portions 21 each are configured by a first line 21*a* passing above a position A corresponding to the greater trochanter (called "greater trochanter position A" hereinafter) and a second line 21 b passing below the greater trochanter position A, and thereby form a closed-loop such as to surround the periphery of the greater trochanter position A as a whole.

The first line 21*a* and the second line 21*b* extend obliquely from an upper side of the back portion 10*b* of the main body portion 10 to a lower side of the front portion 10*a*, and pass across the buttock and the femur so as to connect the outside of upper portions of the wearer's gluteus maximus and gluteus medius to an upper portion of the tensor fasciae latae muscle. The widths of the first line 21*a* and the second line 21*b* are, for example, 2.5 cm through 6 cm, and preferably 4 cm through 6 cm.

Here, the first line 21*a* curves gently upward, while the second line 21*b* curves gently downward. The space between the first line 21*a* and the second line 21*b* gradually becomes wider toward the greater trochanter position A. Accordingly, a part where the main body portion 10 is exposed (this part is called "side hole 24" hereinafter, wherein the provides one of the greater trochanter parts) is formed between the first line 21*a* and the second line 21*b*.

The side hole 24, providing one of the greater trochanter parts, is formed into an approximate ellipse having pointy ends in a longitudinal direction, and extends obliquely from the upper side of the back portion 10*b* of the main body portion 10 to the lower side of the front portion 10*a* so as to follow the directions in which the first line 21*a* and the second line 21*b* extend. This side hole 24 functions as a portion for reducing the tightening forces of the first tightening portions 21 against the greater trochanter. Note that, for the material constituting the portion corresponding to the side hole 24 in the main body portion 10, a material having a tightening force weaker than that of the other parts of the main body portion 10 may be used separately.

The second tightening portions 22 are portions that support an inguinal portion of the wearer. As shown in FIG. 1 and FIG. 5, the second tightening portions 22 are formed into a pair on the right and left sides on the front portions 10*a* of the main body portion 10, integrally with the first line 21 a of the first tightening portions 21. The second tightening portions 22 extend obliquely and substantially parallel to the longitudinal direction of the side hole 24 from a lower end section of the first line 21 a toward an upper portion of the sewing line L2, and are configured to follow the inguinal portion of the wearer when [the exercise garment] is being worn. The width of each second tightening portion 22 is, for example, approximately 3 cm through 6 cm.

The third tightening portion 23 is sections for connecting the right and left first tightening portions 21, 21. As shown in FIG. 3 and FIG. 4, the third tightening portion 23 is integrated with the second line of the first tightening portions 21 and thereby formed into a pair of right and left in the back portion 10*b* of the main body portion 10. The third tightening portion 23 extend obliquely and substantially parallel to the longitudinal direction of the side hole 24, and the right and left third tightening portions 23, 23 are connected to each other by the sewing line L1 on the lower side of the waist portion 10*d* and waist portion 10*d*. The width of [each of] the third tightening portion 23 is, for example, approximately 6 through 8 cm.

With the exercise garment with crotch part 1, when [the exercise garment with crotch part 1] is being worn, tightening forces of the first tightening portions 21 act on the muscle groups surrounding the greater trochanter, such as the gluteus medius, gluteus maximus and tensor fasciae latae muscle, so that when the wearer tries to carry out movement of the trunk or the both legs, [the muscle groups such as the gluteus medius, gluteus maximus and tensor fasciae latae muscle] are supported such that the extent of mobility of the pelvic band is broadened. Because [each of] the first tightening portions 21 is formed into a closed-loop so as to surround the greater trochanter position A, three-dimensional movements such as rotation of the trunk and rotation/outward rotation/inward rotation of both legs, are sufficiently supported.

On the other hand, the side hole 24 is formed on the inside of the closed-loop first tightening portions 21 as the space between the first line 21*a* and the second line 21*b* gradually becomes wider toward the greater trochanter position A. Due to such formation of the side hole 24, the greater trochanter of the wearer is not directly pressed by the first tightening portions 21 so that the greater trochanter itself can move freely. Therefore, in the exercise garment with crotch part 1, the first tightening portions 21 can support the muscle groups existing around the greater trochanter and the side hole 24 can secure flexibility of the pelvic band, whereby performance of various types of exercises such as swing speed of a club head or a racket head can be effectively improved.

Moreover, in the exercise garment with crotch part 1, the tightening forces of the second tightening portions 22 act on the inguinal portion when [the garment] is being worn. Therefore, [the inguinal portion] is supported such that the pelvic band of the wearer tilted slightly forward. By keeping the forward-bent position of the pelvic band, mobility of the trunk/lower limb is enhanced and exercise performance is further improved. Furthermore, in the exercise garment with crotch part 1, at the position corresponding to the lumbar part of the wearer, the right and left first tightening portions 21, 21 are connected to each other by the third tightening portion 23 formed on the back portion 10*b* of the main body portion 10. Accordingly, the wearer's lumbar part is stabilized so that it does not swing, whereby the comfort during exercise is enhanced.

In addition, in the exercise garment with crotch part 1, the first tightening portions 21 extend from the upper side of the back portion 10*b* of the main body portion 10 to the lower side of the front portion 10*a* on the periphery of the greater trochanter, and a long axis of the side hole 24 extends obliquely in the same direction [as the first tightening portions 21]. Such shape is configured in view of the movement of the greater trochanter during exercise when the human body is viewed from a side, and mobility of the trunk/lower limb can be further secured by matching the direction in which the first tightening portions 21 (side hole 24) extend with the direction of the movement of the greater trochanter.

Figure 8:
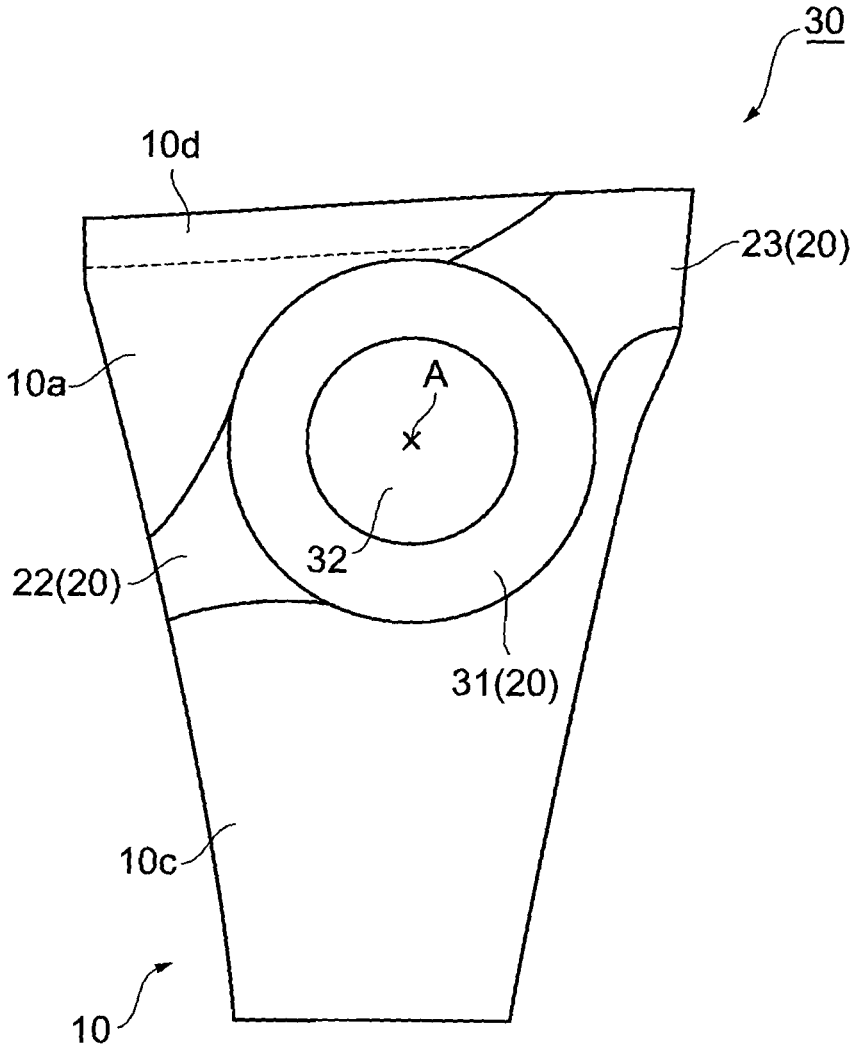
FIG. 8 A side view showing an exercise garment with crotch part according to a variation of the present invention.

Next, an exercise garment with crotch part according to a variation of the present invention is described. FIG. 8 is a side view of an exercise garment with crotch part according to a variation of the present invention.

As shown in FIG. 8, the difference between an exercise garment with crotch part 30 and the above-described embodiment is that [in the exercise garment with crotch part 30] first tightening portions 31 are formed into a perfect circle by a single line, while [in the above-described embodiment] the first tightening portions 21 form an approximate ellipse having pointy ends in a longitudinal direction by means of the first line 21*a* and the second line 21*b*. A side hole 32 is also formed into a perfect circle so as to correspond to the shape of each first tightening portion 31. The rest of the configuration is same as that of the above-described embodiment.

In this exercise garment with crotch part 30 as well, [each of] the first tightening portions 31 is formed into a closed-loop so as to surround the periphery of the greater trochanter position A, thus three-dimensional movements, such as rotation of the trunk and rotation/outward rotation/inward rotation of both legs, are supported, as with the exercise garment with crotch part 1. Moreover, due to such formation of the side hole 32, the greater trochanter of the wearer is not directly pressed by the first tightening portions 31 so that the greater trochanter itself can move freely. Therefore, the muscle groups existing around the greater trochanter can be supported and flexibility of the pelvic band can be secured, whereby performance of various types of exercises can be effectively improved.

Figure 9:
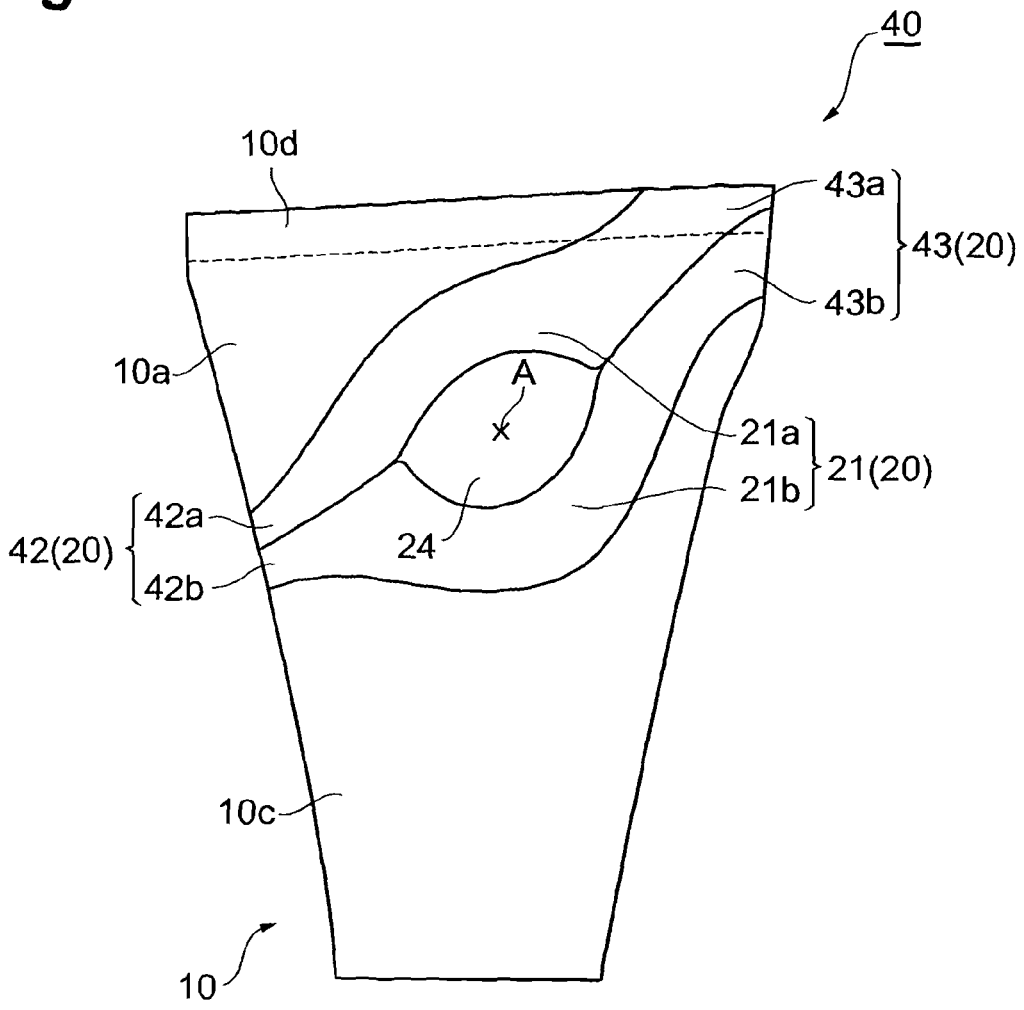
FIG. 9 A side view of an exercise garment with crotch part according to another variation of the present invention.

Furthermore, FIG. 9 is a side view showing an exercise garment with crotch part according to another variation. As shown in FIG. 9, the difference between an exercise garment with crotch part 40 and the above-described embodiment is that [in the exercise garment with crotch part 40] second tightening portions 42 and third tightening portion 43 is formed by first lines 42*a*, 43*a* passing thereabove and second lines 42*b*, 43*b* passing therebelow, respectively, while [in the above-described embodiment] the second tightening portions 22 and third tightening portion 23 is formed by a single line. The rest of the configuration is same as that of the above-described embodiment.

Specifically, in the exercise garment with crotch part 40, the first line 42*a* of a second tightening portion 42 and the first line 43*a* of a third tightening portion 43 are formed integrally with the first line 21*a* of the first tightening portion 21, and extend obliquely and substantially parallel to the longitudinal direction of the side hole 24. Moreover, the second line 42*b* of the second tightening portion 42 and the second line 43*b* of the third tightening portion 43 are formed integrally with the second line 21*b* of the first tightening portion 21, and extend obliquely and substantially parallel to the longitudinal direction of the side hole 24.

In this exercise garment with crotch part 40, [each of] the first tightening portions 21 is formed into a closed-loop so as to surround the periphery of the greater trochanter position A, thus three-dimensional movements, such as rotation of the trunk and rotation/outward rotation/inward rotation of both legs, are supported, as with the exercise garment with crotch part 1. Moreover, due to such formation of the side hole 24, the greater trochanter of the wearer is not directly pressed by the first tightening portions 21 so that the greater trochanter itself can move freely. Therefore, the muscle groups existing around the greater trochanter can be supported and flexibility of the pelvic band can be secured, whereby performance of various types of exercises can be effectively improved.

Next, results of a function test of the above-described exercise garment with crotch part 1 are described.

[Function Test of the First Tightening Portions]

Figure 10:
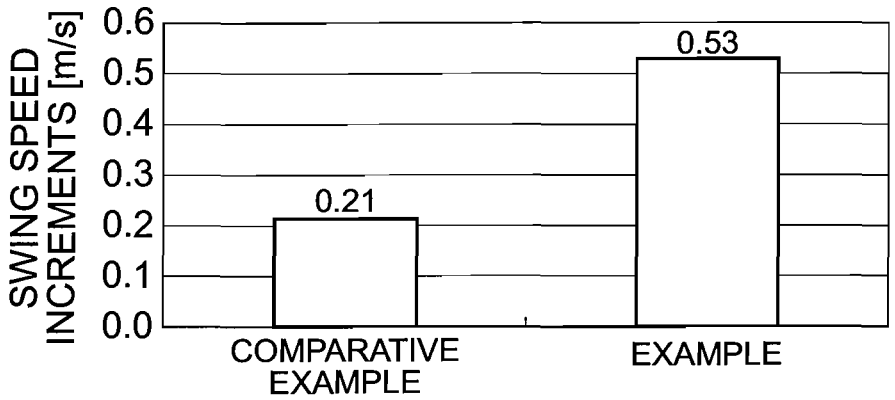
FIG. 10 A view showing results of a function test of first tightening portions.

In a function test of the first tightening portions, first, ten monitors were made to perform a golf swing to measure an average of ten measured swing speeds. Each monitor was made to wear a sample like the exercise garment with crotch part 30 as a working example. Also, [each monitor] was made to wear a sample in which no tightening portions are formed, as a conventional example, and a sample in which no side holes are formed (the greater trochanter position is covered with the tightening portions), as a comparative example. FIG. 10 is a drawing showing results of the test. As shown in the drawing, the average of the increments of the swing speeds of the ten monitors was 0.21 m/s in the comparative example and 0.53 m/s in the working example, with respect to the conventional example.

Figure 11:
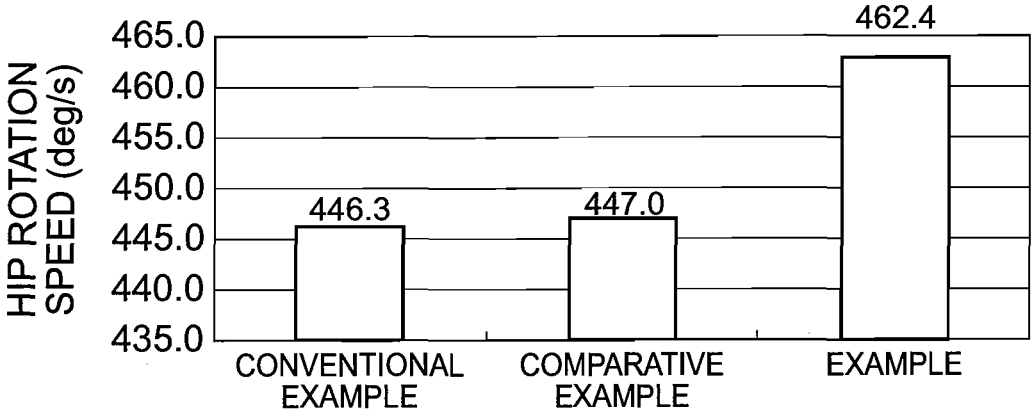
FIG. 11 A view showing results of another function test performed on the first tightening portions.

Next, three monitors were made to perform a golf swing to measure an average of the speeds of rotation of the hips obtained from five swings. Each monitors were made to wear three types of samples for a working example, a comparative example and a conventional example same as those described above. FIG. 11 is a drawing showing results of the test. As shown in the drawing, the average rotation speed of the hips of the three monitors was 462.4 deg/s in the working example, while it was 446.3 deg/s in a conventional example and 447.0 deg/s in a comparative example.

According to the above results, it was found that when the tightening forces are applied directly to the greater trochanter position, the swing speed has improved compared to the conventional example but the hip rotation speed did not change significantly. From this [fact], it was confirmed that movement of the pelvic band is inhibited while tightening force acts on the muscles and effects of improvement of the swing speed cannot be obtained sufficiently in the comparative example. In the working example, on the other hand, it was confirmed that by freely moving the greater trochanter, a natural swing can be realized using the flexibility of the pelvic band, whereby the effects of improvement of the swing speed can be obtained sufficiently.

[Verification Test Performed on the Width of [each of] the First Tightening Portions]

In this verification test, six monitors wearing samples having different widths at the first tightening portions are made to perform a gold swing to measure an average of the increments of ten measured swing speeds. In Working Example 1 the width of [each] first tightening portion was 6.0 cm (external diameter is 18.0 cm, inner diameter is 6.0 cm), and in Working Example 2 the width of [each] first tightening portion was 4.0 cm (external diameter is 18.0, inner diameter is 10.0 cm). Also, in Comparative Example 1 the width of [each] first tightening portion was 4.5 cm (external diameter is 15.0 cm, inner diameter is 6.0 cm), and in Comparative Example 2 the width of [each] first tightening portion was 2.5 cm (external diameter is 15.0 cm, inner diameter is 10.0 cm). In Comparative Example 3 the width of [each] first tightening portion was 3.0 cm (external diameter is 12.0 cm, inner diameter is 6.0 cm).

Figure 12:
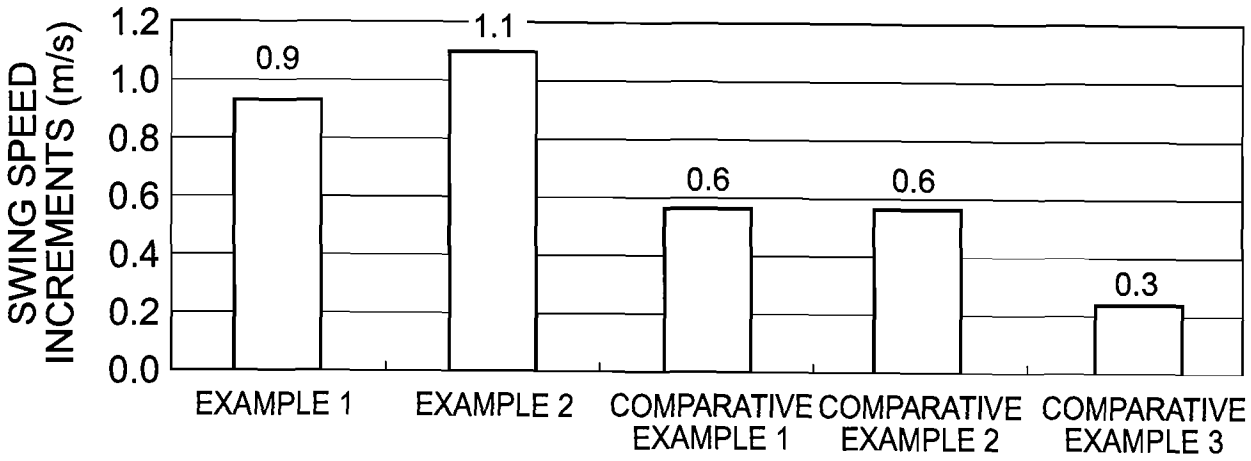
FIG. 12 A view showing results of a verification test performed on the width of [each of] the first tightening portions.

FIG. 12 is a diagram showing results of the test. As shown in the drawing, the average of the increments of the swing speeds of the six monitors was 0.6 m/s in both Comparative Example 1 and Comparative Example 2, and 0.3 m/s in Comparative Example 3. On the other hand, [the average of the increments of the swing speeds of the six monitors] was 0.9 m/s in Working Example 1 and 1.1 m/s in Working Example 2. According to these results, it was confirmed that the width of the first tightening portions is preferably approximately 2.5 cm through 6 cm, and more preferably approximately 4 cm through 6 cm. Note that the external diameter of the first tightening portions is preferably 18 cm or less in view of the shape of the main body portion, and the inner diameter of the first tightening portion is preferably 6 cm or more in consideration of [the difference in] movements of the greater trochanter during exercise and differences among the body shapes of the wearers.

[Function Test of the Second Tightening Portions]

In a function test of the second tightening portions, five monitors were made to perform a golf swing to measure an average of the increments of ten measured swing speeds. Each monitor was made to wear a sample in which the first tightening portions and the second tightening portions are formed, as a working example, and a sample in which only the first tightening portions are formed, as a comparative example. Note that the width of the second tightening portions was 3.5 cm.

Figure 13:
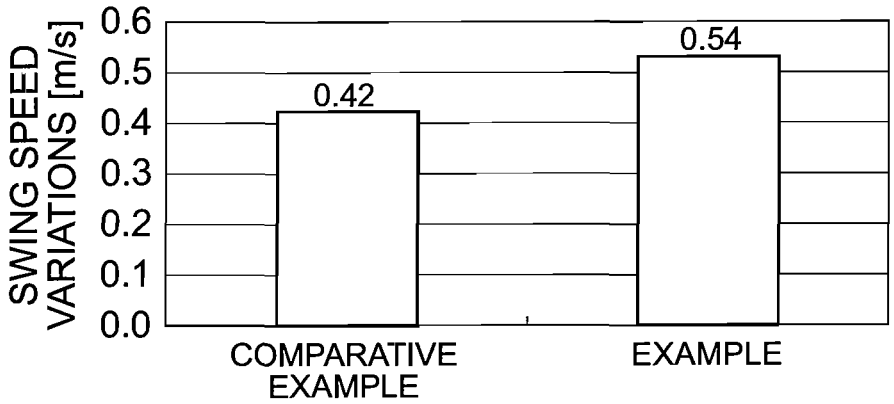
FIG. 13 A view showing results of a function test performed on a second tightening portion.

FIG. 13 is a view showing results of the test. As shown in the drawing, the average of the increments of the swing speeds of the five monitors was 0.42 m/s in the comparative example, while it was 0.54 m/s in the working example. From these [results], it was confirmed that the forward-bent position of the pelvic band that is kept by the second tightening portions contributes to improving exercise performance.

[Function Test of the Third Tightening Portion]

In a function test of the third tightening portion, five monitors were made to perform a golf swing, and how a take back can be taken easily and how the hip is twisted easily during a swing were subjectively evaluated on a scale of 10 with 10 being the perfect score (5 being a reference point). Each monitor was made to wear a sample like the exercise garment with crotch part 1 as a working example. Also, [each monitor] was made to wear a sample in which no tightening portions are formed, as Comparative Example 1, and a sample in which only the first tightening portions and the second tightening portions are formed, as Comparative Example 2.

Figure 14:
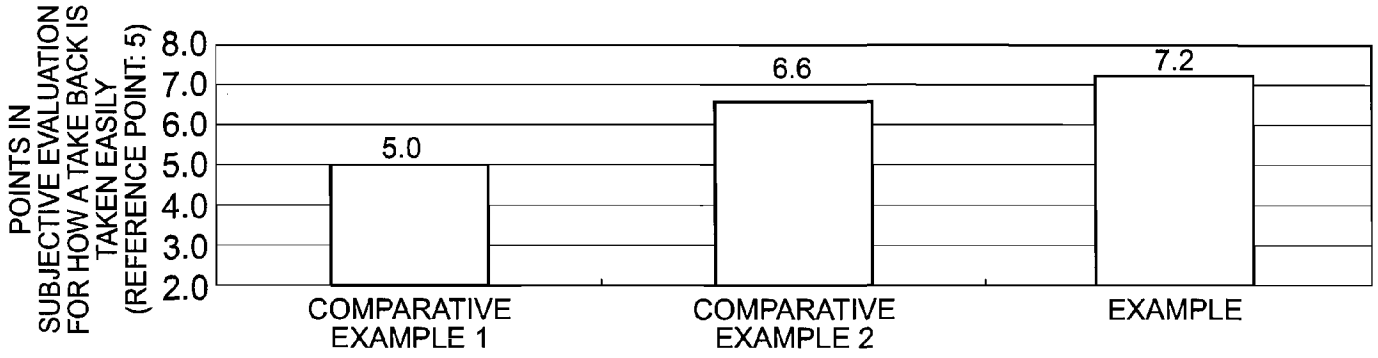
FIG. 14 A view showing results of a function test performed on a third tightening portion.
Figure 14:
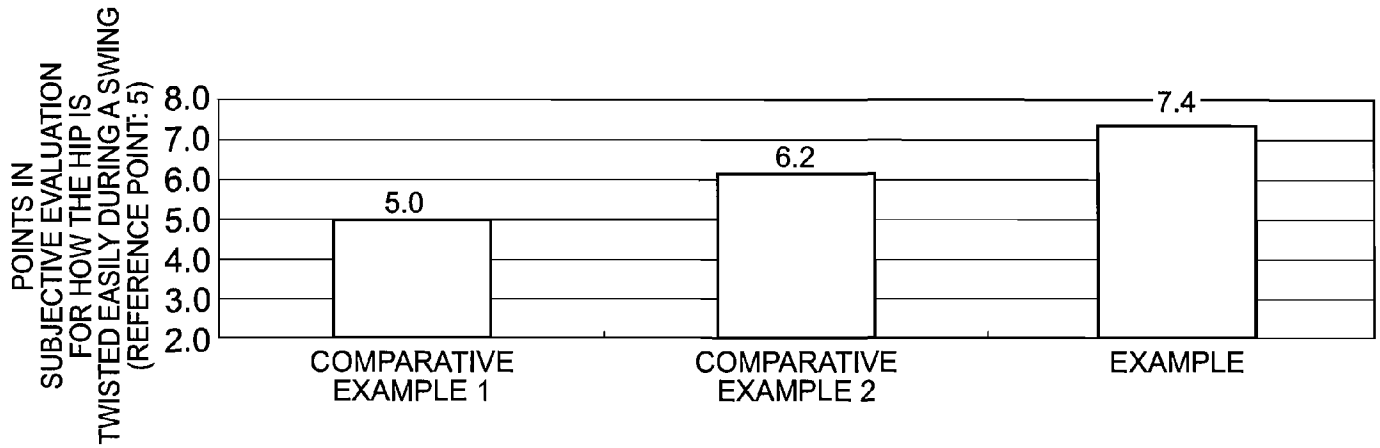

FIG. 14 is a view showing results of the test. As shown in (a) of FIG. 14, regarding how a take back is taken easily, the average obtained from the evaluation of each monitor was 5.0 points in Comparative Example 1 and 6.6 points in Comparative Example 2, while it was 7.2 points in the working example. Also, as shown in (b) of FIG. 14, regarding how the hip is twisted easily during a swing, the average obtained from the evaluation of each monitor was 5.0 points in Comparative Example 1 and 6.2 points in Comparative Example 2, while it was 7.4 points in the working example. From the above results, it was confirmed that making the hip stable using the third tightening portion contributes to improving the comfort during exercise.

Figure 15:
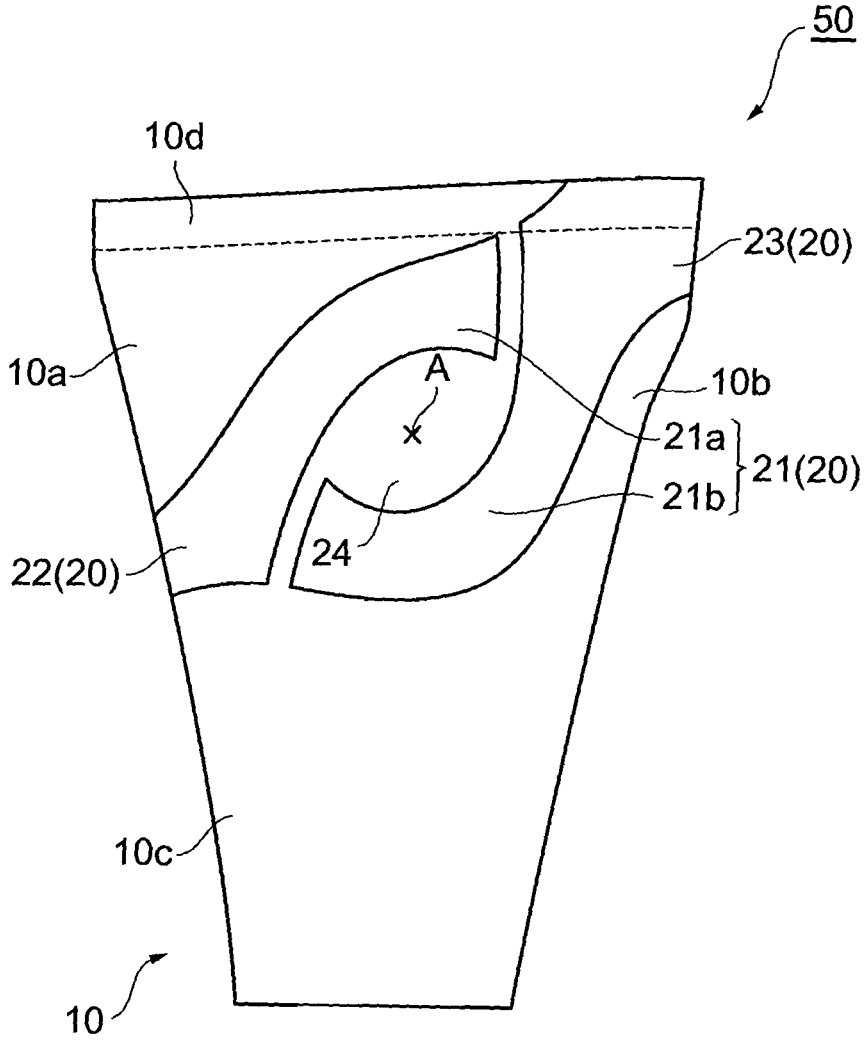
FIG. 15 A side view showing an exercise garment with crotch part according to yet another variation of the present invention.
Figure 16:
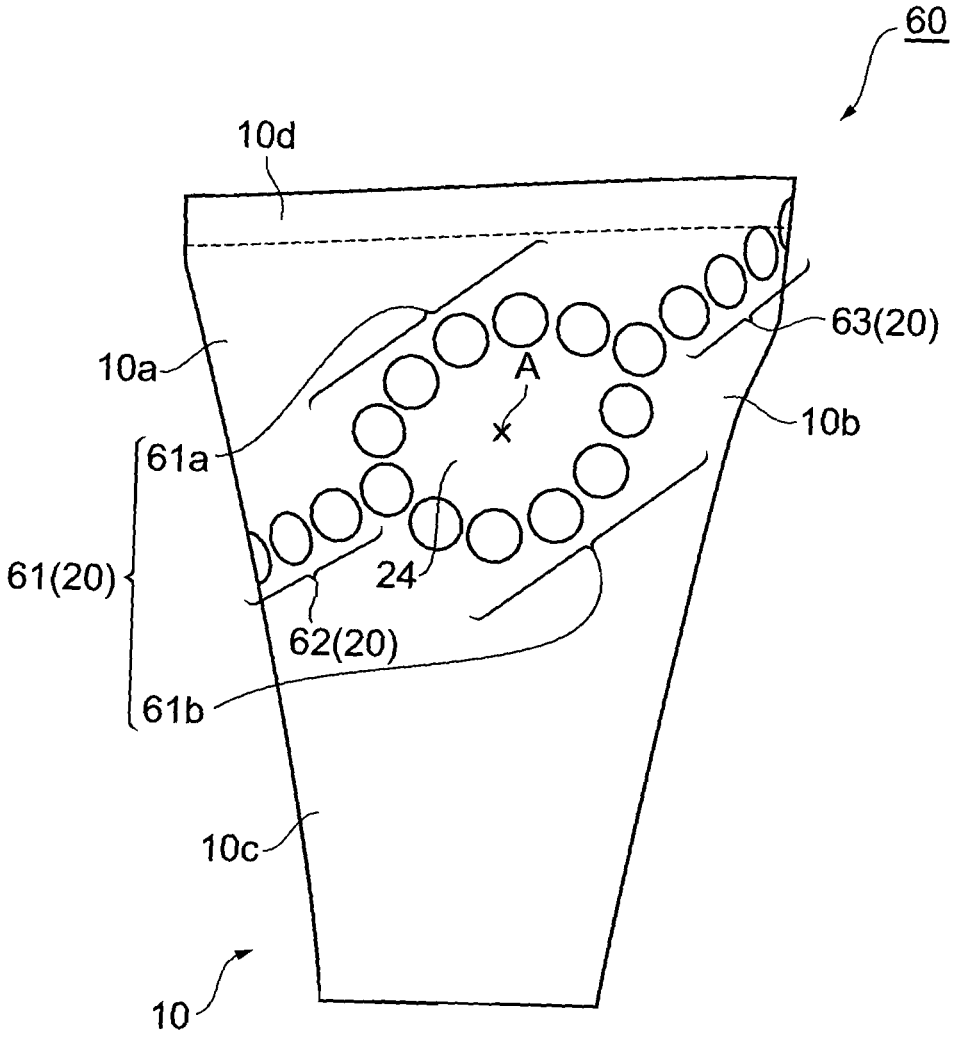
FIG. 16 A side view showing an exercise garment with crotch part according to yet another variation of the present invention.

The present invention is not limited to the above embodiments. For example, with the exercise garment with crotch part 1, 30 or 40 described above, the first tightening portions 21, 31 completely surround the periphery of the greater trochanter position A, but the end portion of the first line 21*a* on the front side and the end portion of the second line 21*b* on the front side may be separated, as well as the end portion of the first line 21*a* on the back side and the end portion of the second line 21*b* on the back side, as in an exercise garment with crotch part 50 shown in FIG. 15. Furthermore, as in, for example, an exercise garment with crotch part 60 shown in FIG. 16, by disposing a plurality of circular tightening portions 20 in the form of a rough line, a first line 61*a* and a second line 61*b* of a first tightening portion 61, a second tightening portion 62, and a third tightening portion 63 may be formed. The circular tightening portions 20 may be arranged in the form of a mesh instead of a single line. The shape of the plurality of tightening portions 20 may be not only a circle but also a square, a star and the like.

The tightening portions 20 may be provided on the inside of the main body portion 10. In this case, the tightening portions 20 are hidden to on the side of the wearer's skin, thus the exercise garment with crotch part 1, 30, 40 can be made to look neater. Moreover, in the embodiments described above, a spat-like garment with crotch part was given as an example, but [the present invention] can be applied to not only the spat-like [garment] but also various garments having a crotch part, such as pants, girdles, tights, stockings and the like.

The invention claimed is:

1. An exercise garment with crotch part that covers at least a part of a wearer's lower body, the exercise garment with crotch part comprising:

a main body portion formed from a stretchable material, the main body portion having a front portion, a back portion, side parts, greater trochanter parts, wherein the greater trochanter parts are configured to cover a wearer's greater trochanter; and a waist portion including an upper edge; and a tightening portion having a tightening force stronger than that of the main body portion, wherein the tightening portion has, in the side parts of the main body portion, a pair of right and left first tightening portions each of which extends downwardly from the waist portion toward a front portion of the crotch part, and wherein each of the pair of right and left first tightening portions includes a pair of curved lines forming a closed-loop shape forming a side hole that encompasses one of the greater trochanter parts of the main body, the side hole having two pointed ends where the curved lines connect, the two ends being pointed in a longitudinal direction, the side hole being positioned diagonally to extend from an upper part of the back portion of the main body portion toward a lower part of the front portion.

2. The exercise garment with crotch part according to claim 1, wherein the tightening portion further has, in a front part of the main body portion, band-like second tightening portions that are connected to the first tightening portions.

3. The exercise garment with crotch part according to claim 1, wherein the tightening portion further has, in a back part of the main body portion, third tightening portion that connects the first tightening portions to each other.

4. The exercise garment with crotch part according to claim 1, wherein the tightening portion further has:

band-like second tightening portions, located in a front part of the main body portion, that are connected to the first tightening portions; and third tightening portion, located in a back part of the main body portion, that connects the first tightening portions to each other, and wherein each of the first tightening portions extends from an upper side of the back part of the main body portion toward a lower side of the front part of the main body portion.

5. The exercise garment with crotch part according to claim 2, wherein the second tightening portions are formed by a plurality of tightening portions.

6. The exercise garment with crotch part according to claim 3, wherein the third tightening portion is formed by a plurality of tightening portions.

* * * * *